US009066172B2

(12) United States Patent
Nguyen et al.

(10) Patent No.: US 9,066,172 B2
(45) Date of Patent: Jun. 23, 2015

(54) ACOUSTIC WAVEGUIDE AND COMPUTING DEVICES USING SAME

(71) Applicant: Apple Inc., Cupertino, CA (US)

(72) Inventors: Anthony Pham Nguyen, San Jose, CA (US); Kevin Scott Fetterman, Los Altos, CA (US); Laura M. DeForest, San Mateo, CA (US); Michael K. Morishita, Belmont, CA (US); Michelle Goldberg, Sunnyvale, CA (US); Stephen Vincent Jayanathan, Oakland, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 13/630,672

(22) Filed: Sep. 28, 2012

(65) Prior Publication Data

US 2014/0093114 A1 Apr. 3, 2014

(51) Int. Cl.

| | |
|---|---|
| ***H04R 25/00*** | (2006.01) |
| ***H04R 1/02*** | (2006.01) |
| ***H04R 1/40*** | (2006.01) |
| ***H04R 1/08*** | (2006.01) |
| ***H04R 31/00*** | (2006.01) |

(52) U.S. Cl.

CPC ..... *H04R 1/02* (2013.01); *Y10T 29/49005* (2015.01); *H04R 1/406* (2013.01); *H04R 1/083* (2013.01); *H04R 2499/15* (2013.01); *H04R 31/00* (2013.01)

(58) Field of Classification Search

CPC ..... H04R 1/02; H04R 1/222; H04R 1/38; H04R 1/08; H04R 1/083; H04R 1/406; H04R 31/00; H04R 2499/15

USPC ..... 381/313, 355, 356, 357, 358, 359, 360, 381/361, 368, 369; 379/420.03, 433.03

See application file for complete search history.

(56) References Cited

U.S. PATENT DOCUMENTS

| | | | | |
|---|---|---|---|---|
| 3,819,879 | A | 6/1974 | Baechtold | |
| 4,336,861 | A | 6/1982 | Peter | |
| 5,012,890 | A | 5/1991 | Nagi et al. | |
| 5,092,424 | A | 3/1992 | Schreiber et al. | |
| 5,210,793 | A | 5/1993 | Carlson et al. | |
| 5,226,076 | A * | 7/1993 | Baumhauer et al. | 379/420.02 |
| 5,260,681 | A | 11/1993 | Asai et al. | |
| 5,261,006 | A | 11/1993 | Nieuwendijk et al. | |
| 5,282,245 | A * | 1/1994 | Anderson | 379/433.03 |
| 5,471,019 | A | 11/1995 | Maire | |
| 5,479,520 | A | 12/1995 | Nieuwendijk et al. | |

(Continued)

FOREIGN PATENT DOCUMENTS

| | | |
|---|---|---|
| EP | 0489551 | 6/1992 |
| JP | 2001211089 | 8/2001 |
| WO | WO 02/34006 | 4/2002 |

*Primary Examiner* — Huyen D Le

(74) *Attorney, Agent, or Firm* — Brownstein Hyatt Farber Schreck LLP

(57) ABSTRACT

Computing devices and microphone assemblies including acoustic waveguides are described. According to some examples, a computing device may include an enclosure, a microphone which may be spaced apart and angled relative to the interior surface of the enclosure to which the microphone may be coupled. The computing device may further include an acoustic waveguide disposed between the microphone and the interior surface of the enclosure, the acoustic waveguide having a passage for allowing acoustic energy to be transmitted from a microphone opening in the enclosure to the receiving element of the microphone (also referred to as sensing element, or microphone sensor).

20 Claims, 7 Drawing Sheets

(56) References Cited

U.S. PATENT DOCUMENTS

| | | | | |
|---|---|---|---|---|
| 5,642,404 | A | | 6/1997 | Hsu |
| 5,701,354 | A | | 12/1997 | Komoda et al. |
| 5,790,679 | A | | 8/1998 | Hawker et al. |
| 5,878,147 | A | * | 3/1999 | Killion et al. ..... 381/313 |
| 5,905,803 | A | | 5/1999 | Dou et al. |
| 6,058,293 | A | | 5/2000 | Phillips |
| 6,389,146 | B1 | | 5/2002 | Croft, III |
| 6,473,625 | B1 | | 10/2002 | Williams et al. |
| 6,614,911 | B1 | | 9/2003 | Watson et al. |
| 6,681,023 | B1 | | 1/2004 | Turnbull et al. |
| 6,728,386 | B1 | | 4/2004 | Andersen |
| 6,758,303 | B2 | | 7/2004 | Zurek et al. |
| 6,868,602 | B2 | | 3/2005 | McCullough |
| 6,965,790 | B1 | | 11/2005 | Mendolia |
| 7,031,455 | B2 | | 4/2006 | Moquin et al. |
| 7,031,486 | B2 | | 4/2006 | Hu |
| 7,069,061 | B2 | | 6/2006 | Gammon et al. |
| 7,120,261 | B1 | | 10/2006 | Turnbull et al. |
| 7,123,736 | B2 | | 10/2006 | Eaton |
| 7,130,420 | B2 | | 10/2006 | Windeballe et al. |
| 7,239,899 | B2 | | 7/2007 | Lin |
| 7,260,364 | B2 | | 8/2007 | Eaton |
| 7,280,855 | B2 | | 10/2007 | Hawker et al. |
| 7,305,253 | B2 | | 12/2007 | Snyder et al. |
| 7,426,280 | B2 | | 9/2008 | Aylward |
| 7,627,343 | B2 | | 12/2009 | Fadell et al. |
| 8,103,029 | B2 | | 1/2012 | Ngia et al. |
| 8,126,138 | B2 | | 2/2012 | Dinh et al. |
| 8,170,256 | B2 | | 5/2012 | Enstad et al. |
| 8,224,012 | B2 | | 7/2012 | Watson et al. |
| 8,306,252 | B2 | | 11/2012 | Dinh et al. |
| 8,483,776 | B2 | | 7/2013 | Murray |
| 2002/0076041 | A1 | | 6/2002 | Hietanen |
| 2007/0237339 | A1 | | 10/2007 | Konchitsky et al. |
| 2008/0123891 | A1 | | 5/2008 | Kato et al. |
| 2008/0149417 | A1 | | 6/2008 | Dinh et al. |
| 2012/0204650 | A1 | | 8/2012 | Kleven |
| 2013/0039508 | A1 | | 2/2013 | Chen et al. |
| 2013/0064390 | A1 | | 3/2013 | Dinh et al. |
| 2014/0226826 | A1 | | 8/2014 | Utterman et al. |

* cited by examiner

ACOUSTIC WAVEGUIDE AND COMPUTING DEVICES USING SAME

TECHNICAL FIELD

The present disclosure relates generally to computing devices and more specifically to acoustic waveguides incorporated in computing devices, for example for coupling a microphone to an enclosure.

BACKGROUND

Computing devices may include certain internal components such as processors, memory, storage devices (e.g. disk drives or solid state drives), thermal management devices, and input/output (I/O) circuitry and interfaces. The internal components of a typical computing device are generally enclosed within a housing or enclosure, which may be made of plastic, metal, glass, and/or any other material suitable for protecting the internal components of the computer and for achieving a desired aesthetic appearance. I/O devices of computing devices may include sound generating components (e.g. speakers) and sound receiving components (e.g. microphones). Typically, the speakers and/or microphone are enclosed within the enclosure of the computing device. An opening is generally formed through the enclosure to allow sound to travel from the speakers to the exterior of the enclosure or from the exterior of the enclosure to the microphone/receiver. Generally, the speakers and microphones of conventional devices are mounted directly adjacent the opening through the enclosure and are typically aligned/co-axial with said openings. Other techniques for mounting speakers and microphones to an enclosure may be desired, some of which may address shortcomings with currently known techniques.

SUMMARY

Microphone assemblies and computing devices incorporating acoustic waveguides according to the present disclosure are described. According to one example, the acoustic waveguide may include a waveguide body, which includes a first surface with an inlet formed therethrough, a second surface with an outlet spaced apart and angled relative to the first surface, and a passage connecting the inlet to the outlet. The passage may be adapted to transmit acoustic energy through an interior portion of the waveguide body. In some instances, a microphone (also referred to herein as a microphone component body or microphone body) may be mounted to the second surface, and the second surface may be adapted for mounting the waveguide/microphone assembly to a structural member of a computing device. For example, the waveguide/microphone assembly may be mounted to an enclosure of the computing device with the first surface adjacent the interior surface of the enclosure and the inlet operatively arranged relative to openings in the enclosure for allowing sound to enter the waveguide and reach the microphone. In other examples, the microphone/waveguide assembly may be mounted to other internal structure, for example brackets or stiffening members of the enclosure, and additional openings and acoustic components may be provided for directing sound from the openings through the enclosure to the microphone.

The waveguide body may have a generally rectangular, trapezoidal, or rhomboid longitudinal cross-section, or may have virtually any other form factor as may be desired or suitable for the particular application. The waveguide body may be a unitary component, which may be molded from a suitable plastic material, for example a Polycarbonate/Acrylonitrile Butadiene Styrene blend (PC/ABS). In some examples, the inlet may be larger than the outlet and a narrowing passage may be formed from the inlet to the outlet. In other examples, the outlet may be larger than the inlet with a diameter of the passage increasing from the inlet to the outlet. The cross-sectional diameter of the passage may, in certain instances, be substantially constant along the length of the passage. In some examples, the centerline of the passage may not be perpendicular to one or both of the first and second surfaces.

Computing devices according to some embodiments of the present disclosure may include an enclosure, a microphone which may be spaced apart and angled relative to the interior surface of the enclosure to which the microphone may be coupled. The computing device may further include an acoustic waveguide disposed between the microphone and the interior surface of the enclosure, the acoustic waveguide having a passage for allowing acoustic energy to be transmitted from a microphone opening in the enclosure to the receiving element of the microphone (also referred to as sensing element, or microphone sensor). The acoustic waveguide may include alignment features for aligning the microphone, for example relative to the passage of the acoustic waveguide. A mesh screen may be disposed at the inlet and/or outlet of the acoustic waveguide, or along a length of the acoustic waveguide to prevent debris from plugging the passage or from damaging the microphone sensor. In some examples, the mesh screen may be disposed between the interior surface of the enclosure and the inlet of the acoustic waveguide. In certain examples, the mesh screen may be adhered to the waveguide body or it may be held in place by a rigid holder located between the interior surface of the enclosure and the inlet.

In some examples, the acoustic waveguide and microphone may be adhered to the enclosure, or they may be attached to one another and the enclosure using other conventional mounting techniques, for example by fastening the two together. One or more openings may be formed in the enclosure to allow sound to penetrate the enclosure. The acoustic waveguide may be configured to acoustically couple all of the openings with the passage. In certain examples, the inlet of the acoustic waveguide may be smaller than a diameter of the opening or smaller than an effective area of the plurality of openings. In this regard, one or more of the plurality of opening may be blocked by the waveguide body and may therefore be inoperable to transmit sound to the interior of the passage. As such one or more of the plurality of openings may not be acoustically coupled with the passage and may instead serve an aesthetic purpose.

According to some examples, the computing device may include two or more microphones arranged in proximity to each other, for example for the purpose of facilitating acoustic beam forming. As such, the location of one of the microphones relative to the other microphone may be an important consideration. In such examples, the second microphone may be coupled to the enclosure at a location proximate the first microphone. The first and second microphones may be coupled to circuitry of the computing device (e.g. processing circuitry or other) using one or more connector cables or conductive paths formed on a flexible substrate (e.g. flexible printed circuit board, also referred to as flex PCB). In some examples, both the first and second microphone may be mounted to the same surface of the enclosure and/or the bases of the first and second microphone bodies may lie in substantially the same plane. In other instances, the first and second microphones may be angled relative to one another (e.g. the microphones may be mounted to adjacent surfaces, such as a back surface and a top surface of the enclosure). The mounting surfaces to which the first and/or second microphone bodies are mounted may be machined or otherwise formed to provide recesses for mounting the microphone bodies therein. When mounted, at least portions of the base of the first and/or second microphones may be recessed relative to the interior surface of the enclosure.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION

Figure 1:
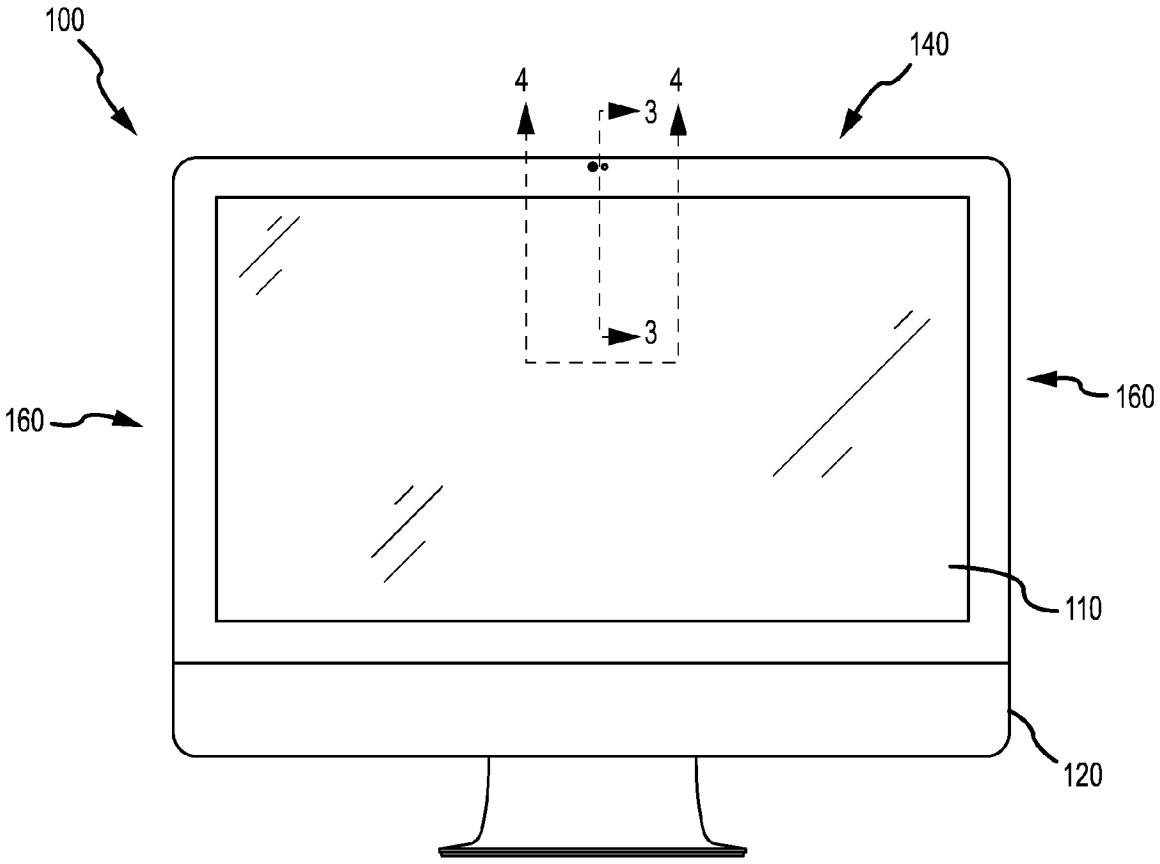
FIG. 1 is a front view of an example of a computing device according to the present disclosure.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

Figure 2:
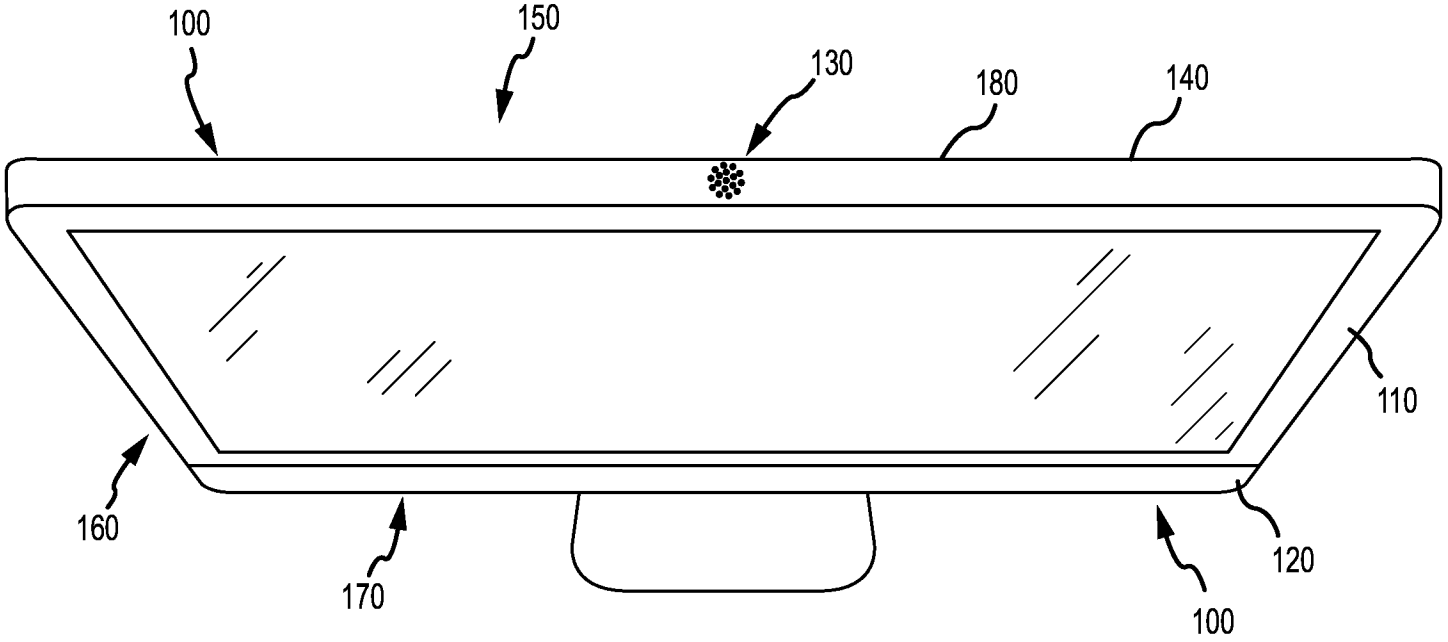
FIG. 2 if a top perspective view of the computing device in FIG. 1

The present disclosure relates generally to computing devices and more specifically to microphone assemblies of computing devices including acoustic waveguides as will be further described. FIGS. 1 and 2 show a computing device according to one example of the present disclosure. The computing device 100 may be a desktop computer with an integrated architecture (also referred to herein as "all-in-one" architecture). By integrated architecture it is meat that the internal computer components, such as processing units, memory, storage devices, input/output devices and other desired components, may be integrated with the display module and/or enclosed within a single enclosure. However, it will be understood that the examples of the present disclosure are equally applicable to computing devices which do not incorporate some or all of the components above. That is, the example described herein in may be implemented with any video display device such as an LCD, LED, or other flat screen technologies, whether or not the display device includes additional computing components auxiliary to the functionality of the display. Other examples according to the present disclosure may include portable devices, for example laptops, tablets, handheld devices including smart phones, and the like. Virtually any computing device with a built-in microphone may incorporate some or all of the features described herein.

The computing device 100 (interchangeably referred to herein as computer 100) includes a display module 110, an enclosure 120, and certain internal components (not shown) as may be needed for performing desired functions of the computing device 100. The computing device 100 may be configured with audio capability (e.g. configured to output and/or receive sound inputs). In this regard, the computing device 100 may include speakers for outputting sound and/or a microphone for receiving sound inputs. The microphone may be enclosed within the enclosure 120 and may be referred to as an internal microphone or built-in microphone. In order for sound to be able to reach the internal microphone, the enclosure 120 may include one or more microphone openings 130 (also referred to herein as a plurality of holes, holes, or a hole pattern 130) arranged in a circular, rectangular, triangular or virtually any other pattern or random arrangement. The microphone openings may be micro-holes in that their diameter may be less than 1 mm each. In some examples, the micro-holes 130 may have diameters from about 0.5 mm to about 0.9 mm, or in some examples, their diameters may be less than about 0.5 mm. In some instances a single hole may be used, which does not need to be of micro-diameter dimension but may be sized to have a diameter of up to 1 cm. Holes of greater than 1 cm may also be used. Some or all of the holes 130 may be formed through the thickness of material 180 of the enclosure. In certain examples, one or more of the holes 130 may be blind holes in that they do not penetrate the interior surface of the enclosure. In this regard, these holes may not function to deliver sound to the interior of the enclosure, but may instead serve an aesthetical purpose.

The one or more microphone openings 130 may be located at a top portion 140 of the enclosure 120. In other examples, the microphone openings 130 may be located at any other desired location, for example the back portion 150, side portion 160, or bottom portion 170 of the enclosure 120. According to some examples, and as will be further described with reference to FIGS. 3 and 4, more than one microphones may be provided and operatively arranged for enhancing the acoustic performance of the microphone assembly. In such examples, an additional plurality of hole patterns 130' may be formed through the enclosure at a second location, for example at the back portion 150.

Figure 3:
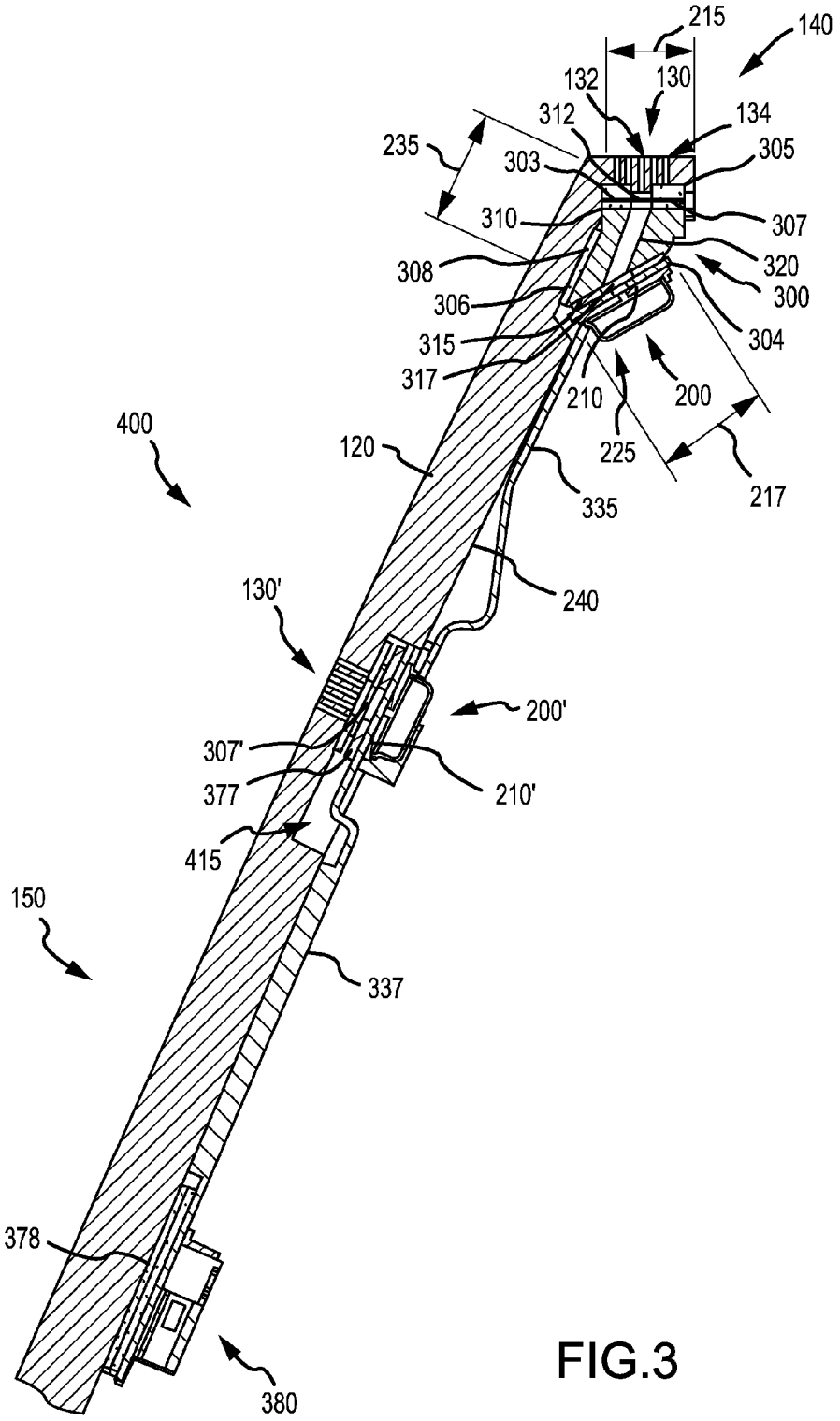
FIG. 3 is a partial section view of the computing device in FIG. 1 taken along the line 3-3 shown in FIG. 1.
Figure 3A:
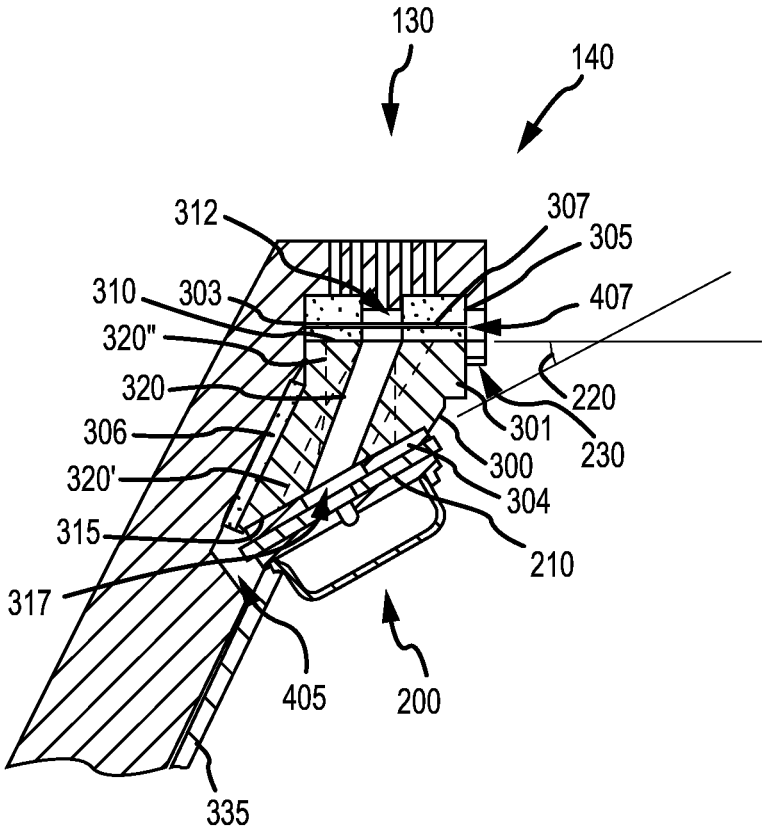
FIG. 3A is a detail view of the partial cross section if FIG. 3.
Figure 4:
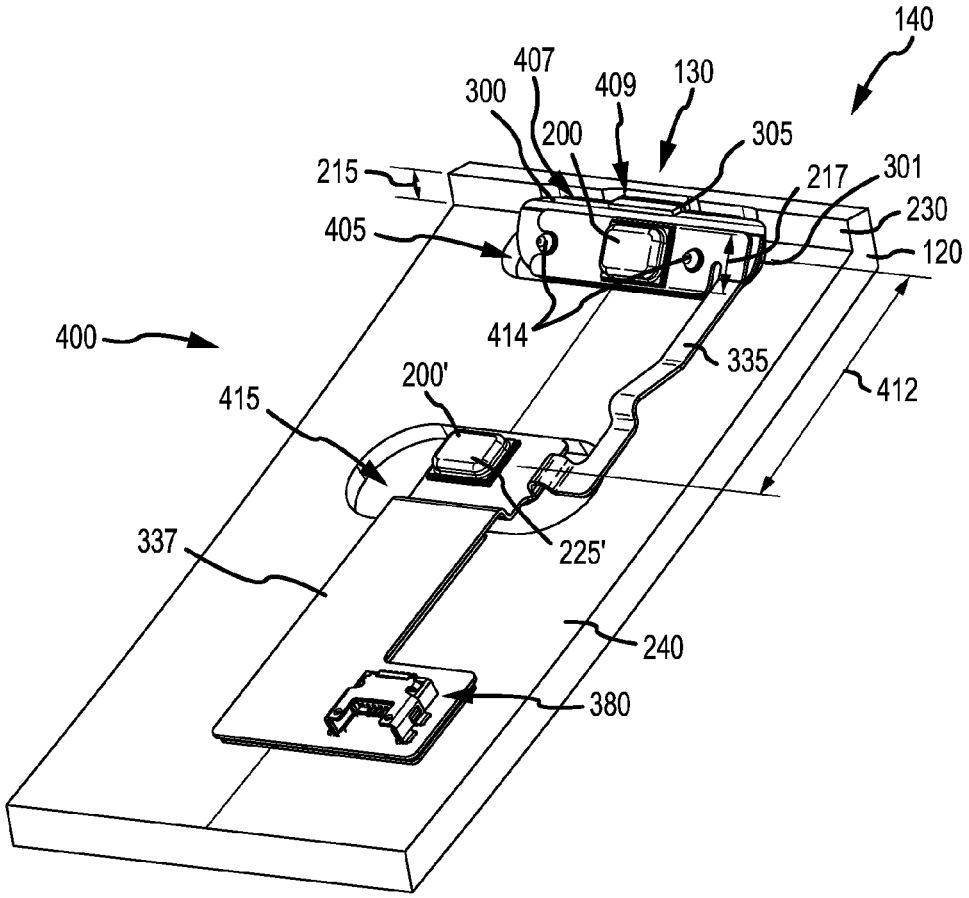
FIG. 4 is a partial section view of a microphone assembly according to an example of the present disclosure, taken along the line 4-4 shown in FIG. 1.

FIGS. 3 and 3A show a partial cross-section taken along the line 3-3 shown in FIG. 1, and FIG. 4 shows a partial cut-away view of the computing device 100 of FIG. 1 taken along the line 4-4 shown in FIG. 1. For clarity and simplicity, only certain components of the computing device 100 are depicted in FIGS. 3-4, for example the microphone 200, waveguide 300, and others as may be needed to understand the relative arrangement and functionality of components of the microphone assembly. Other components of the computer 100, for example the display module 110 and other internal computer components, have been omitted so as not to obfuscate the disclosure. Generally any suitable microphone 200, currently known or later developed, may be coupled to an enclosure of a computing device (e.g. the enclosure 120) according to the examples herein. The microphone sensor or sensing element (not shown) may be sealed or enclosed, at least in part, within the casing 225. The microphone sensor may be a diaphragm or other sensing component such as piezoelectric, capacitive, fiber-optic or other type of sensor configured to transduce pressure/acoustic waves within the audible range. The casing 225 may be formed from virtually any rigid material, for example plastic or metal, suitable for enclosing and protecting the sensing element of the microphone. The microphone 200 may be operatively coupled to circuitry or other electronics of the computer 100, for example for providing power to the microphone and/or for transmitting signals received by the microphone sensor to processing circuitry of the computer 100 (not shown).

The microphone 200 (also referred to herein as microphone body or microphone component body) may have a rectangular base 210 and generally rectangular casing 225 (see e.g., FIG. 4). Other form factors, including but not limited to circular, oval, or other irregular shapes, may also be used. In conventional computing devices, the internal microphone is generally mounted immediately adjacent the microphone opening, the base of the microphone abutting and/or parallel to the surface through which the microphone opening is formed. In this regard, in conventional devices the microphone opening and microphone base may be generally coaxially aligned.

Referring now to FIGS. 3 and 4, in some instances it may be desirable to mount the microphone 200 to a surface, the width 215 of which may be less than a width 217 of the base of the microphone 200. According to examples of the present disclosure, the microphone 200 may, in such instances, be mounted in a spaced apart and rotated position (e.g. base 210 of the microphone may be angled relative to the interior surface 230) thereby decreasing the effective width required to be accommodated within the space defined between the surface 230 and adjacent interior surface 240 of the enclosure. However, while the base 210 of the microphone 200 in the present example is shown to be wider than the width of the available mounting surface, the present disclosure is not limited in this regard and may be equally applicable to microphone bodies with a width 217 equal to or less than the width 215.

As shown in the present example, the microphone body 200 may be spaced apart from the interior surface 230 of the enclosure a distance 235 sufficient to allow the microphone 200 to be angled a desired amount. An angle 220 (see FIG. 3A) may be defined between surface 230 and the base 210, which angle may be varied as desired and/or based on design considerations. In some examples, an angle 220 of about 25-50 degrees may be formed. In other examples the angle may range from about 10 degrees to about 75 degrees. An acoustic waveguide 300 may be disposed between the microphone 200 and enclosure 120 for coupling the two together and for directing acoustic waves (also referred to as sound waves, acoustic energy, or acoustic/pressure waves) to the microphone 200 as may be desired. The acoustic waveguide 300, which may be implemented as a molded plastic component, may span the distance 235 coupling the microphone body 200 to the enclosure 120.

The acoustic waveguide 300 may be implemented as a unitary component formed from a generally rigid plastic, such as PC/ABS blend of plastic. The waveguide 300 may be a molded component or it may be machined to the desired shape. With the exception of the passage 320 described further below, the body 301 of the acoustic waveguide 300 may be a solid piece of PC/ABS material shaped for cooperating fit with the contours of the enclosure. Opposing surfaces 310, 315 of the waveguide 300 may be arranged such that the first surface 310 (also referred to as the enclosure interface surface 310) and the second surface 315 (also referred to as the microphone interface surface 315) are angled relative to one another. The angle 220 defined between the first and second surfaces of the waveguide (see FIG. 3A) may be any acute angle. In some examples, the first and second surfaces may be parallel to each other. In such examples, an interior space sufficient to accommodate the microphone 300 may be defined between the surfaces 230 and 240 and/or the microphone 300 may be spaced apart from the surface 230 by a distance which allows the microphone 230 to be mounted generally parallel to the surface 230.

The acoustic waveguide 300 may include a first opening or inlet 312 at the first surface 310, and a second opening or outlet 317 at the second surface 315. An acoustic passage or tunnel 320 connects the inlet 312 to the outlet 317. The passage 320 may follow a generally straight line, which may or may not be perpendicular to one or more of the surfaces 310 and 315. The passage 320 may be angled, curved, or otherwise configured as may be desired. The passage 320 may include some segments some of which are generally straight and/or have a constant inner diameter, and may include other segments which are curved or angled and/or have a varying inner diameter. The inlet 312 and outlet 317 may or may not be the same size. In certain examples, as shown in FIG. 3A, the inlet may be smaller than the outlet and the diameter of the passage 320' may vary along the length of the passage with the width of the passage 320' expanding towards the base 210 of the microphone 200. In other examples, the inlet may be smaller than the outlet, the width of the passage 320" decreasing along the its length from the inlet to the outlet of the passage. Other variations may be used if desired, for example a tunnel which contracts initially from the base and expands again before reaching the microphone base 210. The reverse configuration (e.g. a tunnel contracting to a narrow intermediate portion and expanding again before the outlet) may also be used.

As described above, the hole pattern 130 may include one or a plurality of holes, some of which may be blind holes. In other examples, the inlet 312 of the acoustic waveguide may be smaller than an effective diameter of the hole pattern thereby causing some of the perimeter holes 134 to be blocked by the waveguide body 301, as shown in FIG. 3A. In this embodiment, only certain holes, for example the central holes 132, may allow for acoustic waves to reach the interior of the passage 320. In yet other examples a single hole may instead be used, which may be smaller or larger than the inlet 312, or it may be generally the same size as the inlet 312.

One or more mesh screens 307 may be included in the microphone assembly to prevent debris from damaging the microphone or otherwise plugging the passage 320 of the acoustic waveguide. The mesh screen 307 (interchangeably referred to as mesh 307) may be attached directly to the first surface 310 of the waveguide body 301. In some examples, the mesh screen 307 may be provided in a mesh holder 305. The mesh holder 305 may be a generally rigid component including top and bottom plates with an aperture in each plate, the mesh holder 305 being configured to retain perimeter portions of the mesh 307 between the top and bottom plates. The mesh 307 may be adhered to the top and/or bottom plates of the mesh holder 305 using adhesive 303. The mesh holder 305 may be adhered or otherwise attached to the surface 310 of the waveguide body 301. The microphone base 210 may be adhered to the opposite side of the waveguide body (e.g. to the surface 315) using an adhesive member 304. An additional adhesive member 306 may be used between the surface 240 and a sidewall 308 of the waveguide body 301.

According to some examples, the microphone assembly 400 may include a second microphone 200' which may be located at a predetermined distance 412 away from the first microphone. The distance 412 may be an important consideration and may determine certain dimensions or other features of the acoustic waveguide 300. The second microphone 200' may be virtually the same as the first microphone in that it may include a sensing element enclosed within casing 225'. The second microphone 200' may be mounted substantially parallel to the surface 240 and/or recessed relative to surface 240 (e.g. microphone 200' may be mounted in recessed portion 415). A spacer 377 may be provided between the microphone 220' and the recessed portion 415. Analogous to the microphone 200, a mesh 307' may be included at the second microphone 200' between the mounting surface and the spacer 377, or the mesh 307' may be integrated with the spacer 377.

The microphone assembly 400 may include other electronic components. For example the electronic component 380 may be an analog to digital (A/D) converter or other electronic devices as may be needed for coupling signals from the microphones 200, 200' to other circuitry (e.g. processing circuitry (not shown)) of the computer 100. The electronic component 380 may be adhered to the enclosure using adhesive member 378 or otherwise mechanically fastened thereto. The one or more microphones 200, 200' may be coupled to the component 380 using connector cables or circuitry provided on flexible substrates (e.g. first and second flex PCB 335, 337).

Figure 5:
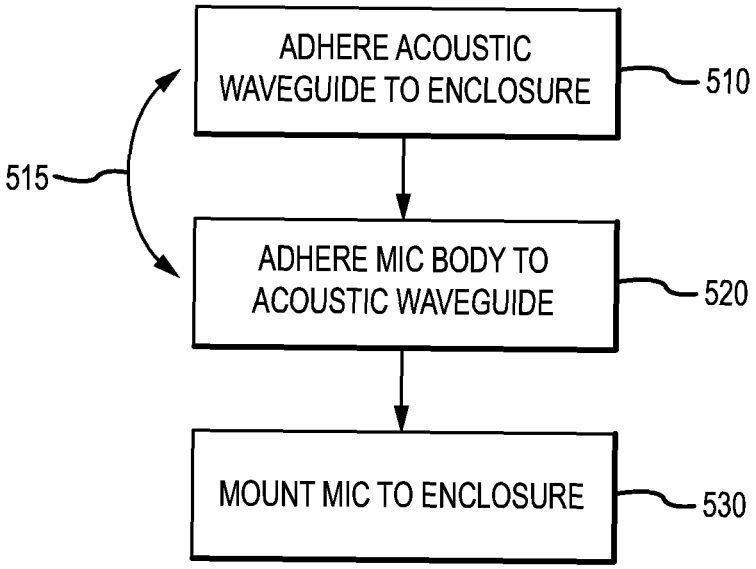
FIG. 5 is a flow diagram of a method of mounting a microphone to an enclosure according to an example of the present disclosure.

According to one example and as shown in FIG. 5, a method of mounting a microphone to an enclosure of a computing device may include adhering an acoustic waveguide to one or more interior surfaces of an enclosure, as shown in box 510, and adhering a microphone component to the acoustic waveguide, as shown in box 520, such that a sensing element of the microphone component is angled relative to the one or more interior surfaces of the enclosure. To achieve this, a microphone body 200 as described herein may be adhered to an acoustic waveguide 300 having first and second surfaces (e.g. surfaces 310, 315 respectively) which are spaced apart from each other and angled relative to one another. In some embodiments, the microphone 200 may be adhered to the waveguide body 300 prior to the waveguide body 300 being attached to the enclosure 120. In other examples, the order of the steps may be reversed, as indicated by the arrow 515.

Figure 6:
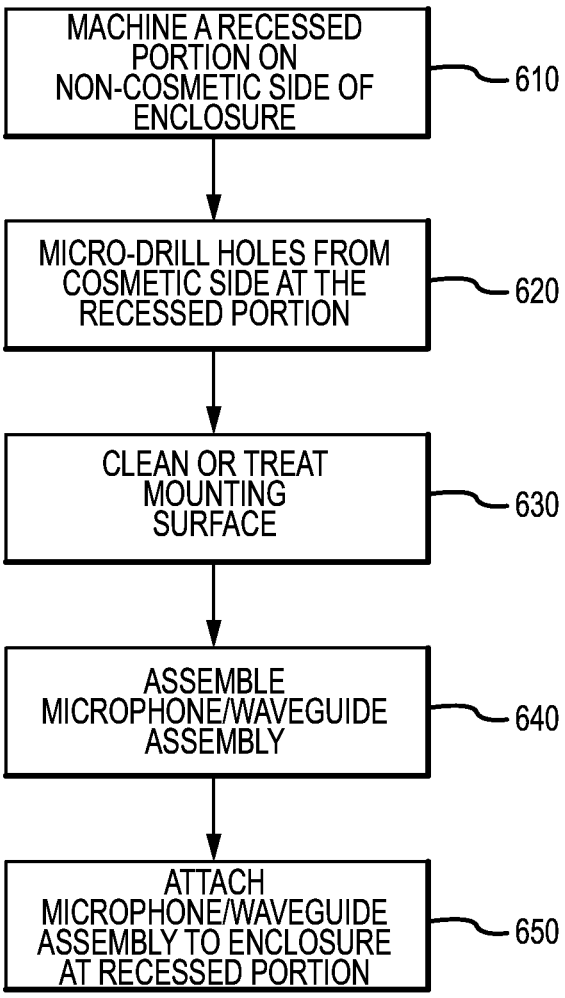
FIG. 6 is a flow diagram of another method according to the present disclosure.

Prior to attaching the microphone 200, interior surfaces (e.g. non-cosmetic sides) of the enclosure may be machined (see box 610 of FIG. 6) or otherwise formed to provide one or more recessed portions 405, 407, 409, and 415, for accommodating the one or more components of the microphone assembly therein. A first recessed portion 405 may be machined in the surface 240 for accommodating the width of the waveguide 300 and effective width of microphone 200 in its angled configuration. The surface 230 may also be machined to a first thickness defining recessed portion 407 and then stepped down to a second thickness to define recessed portion 409 for receiving the mesh holder. In addition to design space requirements, the thickness of stepped down recessed portion 409 may be selected based on certain manufacturing considerations. For example, through holes 130 may be formed through the thickness of surface 230, for example using a micro drilling process (also referred to as drilling or micro-hole drilling) as shown in box 610. Micro-hole drilling may be performed with mechanical cutting tools (e.g. drill bits) or with laser cutting from the cosmetic or non-cosmetic sides of the enclosure. In certain embodiments, for example to facilitated mass production, multiple ones of the holes 130 may be machined simultaneously. In the case of mechanical cutting, it may be desirable to limit the maximum thickness of the material so as to prolong the life of the drill bits. Such considerations may apply to any of the recessed portions (e.g. 409, 415) through which a hole pattern (e.g. 130, 130') is to be micro-machined. In this regard the maximum thickness of the material at the recessed portions 409, 415 may be limited to a thickness less than a thickness of the raw material, and accordingly the enclosure may be machined down to the desired thickness prior to drilling the holes and attaching the microphone components.

After forming recessed portions 405, 407, 409, and 415, the interior surfaces (e.g. 230, 240) may be cleaned or otherwise treated (see box 630) to ensure a quality bond between components adhered thereto. The same or different adhesives may be used for some or all of the components of the microphone assembly. Other conventional techniques for attaching the components may be used instead of or in combination with adhesives, for example, welding, fusing, fastening, or the like.

A microphone/waveguide assembly may be formed, as shown in box 640, and as described herein. The waveguide may include a mesh screen 307, which may be mounted directly to the enclosure interface surface 310 or coupled to the waveguide using a mesh holder. The microphone 200 may be attached to the opposite surface of the waveguide, and the microphone/waveguide assembly may then be adhered to the enclosure at the recessed portion. The second or microphone interface surface 315 may include alignment pins 414, which may be used to align the microphone 300 with the waveguide body 301.

As described above with reference to FIG. 5, in some examples, the waveguide may be attached to the mounting surface prior to the microphone and other electronics are coupled thereto. That is, instead of assembling the microphone/waveguide assembly at step 640, in some examples may instead include mounting the The microphones 200 and 200' (if used) may be coupled to circuitry provided on a flexible substrate, for example a flexible printed circuit board (flex PCB). The flex PCB may operatively couple the tow microphones and/or may be configured to deliver signals from the sensing elements of each microphone to other electronic components (e.g. component 380 which may be or include a A/D converter). The flex PCB may be longer than the distance between the mounted microphones, and the excess flex PCB may be jogged to allow for a certain amount of give between the components, for example to allow for deformation of materials (e.g. expansion/contraction of the metallic enclosure). In other examples, the microphones 200, 200' may be mounted to a rigid circuit board (e.g. rigid PCB). In such examples, flexible connector cables may be used to connect the rigid PCBs to which the microphones are mounted to.

The acoustic waveguides described herein may allow for a variety of coupling arrangements between a microphone body and a mounting surface. Microphones in conventional computing devices are provided in a generally aligned configuration. That is, the microphone body may generally be mounted parallel to the surface of the protective housing or enclosure, and the centerline of the microphone body in conventional computing devices is generally aligned with the centerline of the opening in the enclosure through which sound enters the enclosure.

According to the examples herein, a microphone body may be arranged in an offset or deliberately misaligned configuration relative to the surfaces and/or openings in the enclosure. As described, the microphone body may have its base being positioned at an angle relative of the surface of the enclosure and consequently the centerline of the microphone body may not be co-axial with the centerline of the opening but may instead be angled. Acoustic waveguides according to the present disclosure may be implemented to bridge the space defined between the mounting surface and the base of the microphone and passages may be provided within the body of the waveguides for directing acoustic waves from the exterior of the enclosure towards the sensing element of the microphone. The waveguides described herein may allow for versatile placement of the microphone component, e.g., without having to align the centerline of the opening to a centerline of the sensor. In this regard, an acoustic passage or tunnel may be used to effectively couple the acoustic waves entering the opening of the enclosure with the sensing element of the microphone. Many variations of acoustic waveguides may be possible, for example waveguides with constant or varying passage diameter, or waveguides with regular or irregular shapes, and the examples described herein are provided for illustration only and are not limiting.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A computing device comprising:

an enclosure comprising:

a top portion comprising an interior surface; and microphone openings formed through the top portion and the interior surface;

a microphone spaced apart from the interior surface of the enclosure, the microphone obliquely angled relative to the interior surface of the top portion of the enclosure; and an acoustic waveguide, distinct from, disposed between, and coupled the microphone and the interior surface of the enclosure, the acoustic waveguide comprising:

a first surface having an inlet, the first surface coupled to the interior surface of the top portion of the enclosure;

a second surface having an outlet coupled to the microphone, the second surface spaced apart and angled relative to the interior surface of the top portion of the enclosure; and a passage therethrough for allowing acoustic energy to be transmitted through a body of the acoustic waveguide from the inlet of the first surface to the outlet of the second surface.

2. The computing device of claim 1, wherein the acoustic waveguide includes alignment features for aligning the microphone relative to the passage of the acoustic waveguide.

3. The computing device of claim 1, further comprising a mesh screen disposed between the interior surface of the enclosure and the passage of the acoustic waveguide.

4. The computing device of claim 1, wherein the microphone is a first microphone, the computing device further comprising a second microphone coupled to the enclosure.

5. The computing device of claim 4, wherein the first and second microphones are electrically coupled to processing circuitry using conductive paths formed on one or more flexible substrates.

6. The computing device of claim 4, wherein a base of the first microphone is at an angle relative to a base of the second microphone.

7. The computing device of claim 4, wherein the second microphone is recessed relative to the interior surface of the enclosure.

8. The computing device of claim 4, wherein the first microphone is adhered to the acoustic waveguide.

9. The computing device of claim 1, wherein the microphone openings are operatively arranged to couple acoustic waves from an exterior of the enclosure to an interior of the passage.

10. The computing device of claim 9, wherein at least one of the microphone openings does not transmit sound to the interior of the passage.

11. The computing device of claim 1, wherein the microphone is obliquely angled relative to the interior surface of the top portion of the enclosure between approximately 10 degrees and approximately 75 degrees.

12. A microphone assembly comprising:

a waveguide body positioned adjacent microphone openings formed through an interior surface of an enclosure for a computing device, the waveguide body comprising:

a first surface including an inlet, the first surface coupled to the interior surface of the enclosure;

a second surface including an outlet positioned opposite the first surface, the second surface spaced apart and obliquely angled relative to the interior surface of the enclosure; and a linear passage connecting the inlet and the outlet, the linear passage obliquely angled relative to the interior surface of the enclosure; and a microphone body coupled to the second surface of the waveguide body, the microphone body obliquely angled relative to the interior surface of the enclosure; wherein the passage of the waveguide body transmits acoustic energy to the microphone body through the acoustic waveguide; and wherein the oblique angle of the passage is distinct from the oblique angle of the microphone body.

13. The microphone assembly of claim 12, wherein a diameter of the passage of the waveguide body is constant along the length of the passage.

14. The microphone assembly of claim 12, wherein the inlet is larger than the outlet.

15. The microphone assembly of claim 12, wherein the waveguide body comprises molded plastic.

16. A method of mounting a microphone to an enclosure of a computing device, the method comprising:

adhering an acoustic waveguide to an interior surface of the enclosure including microphone opens formed therein, the acoustic waveguide comprising:

a first surface including an inlet, the first surface coupled to the interior surface of the enclosure;

a second surface including an outlet, the second surface spaced apart and angled relative to the interior surface of the enclosure; and a passage connecting the inlet and the outlet for transmitting acoustic energy through the acoustic waveguide, the passage obliquely angled relative to the interior surface of the enclosure ; and adhering a microphone to the second surface of the acoustic waveguide, the microphone obliquely angled relative to the interior surface of the enclosure.

17. The method of claim 16, wherein the adhering of the microphone is performed prior to the adhering of the acoustic waveguide to the interior surface of the enclosure.

18. The method of claim 16, wherein the adhering of the acoustic waveguide further comprises:

adhering the first surface of the acoustic waveguide to the enclosure; and adhering a third surface connecting the first and second surfaces to the enclosure.

19. The method of claim 16 further comprising locating the acoustic waveguide and microphone proximate a distinct microphone mounted to the enclosure.

20. The method of claim 19 further comprising coupling the microphone and the distinct microphone to circuitry provided on a flexible substrate.

* * * * *